US011002480B1

(12) United States Patent
El Sayed et al.

(10) Patent No.: US 11,002,480 B1
(45) Date of Patent: May 11, 2021

(54) SIDE WALL ATTACHMENT SYSTEM FOR EXTRACTABLE WINE SHELVES

(71) Applicant: WHIRLPOOL CORPORATION, Benton Harbor, MI (US)

(72) Inventors: Kamil El Sayed, Wroclaw (PL); Karol Michał Kostka, Wroclaw (PL)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/725,169

(22) Filed: Dec. 23, 2019

(51) Int. Cl.
*F25D 25/02* (2006.01)
*F25D 11/00* (2006.01)
*F25D 23/06* (2006.01)

(52) U.S. Cl.
CPC ..... *F25D 25/024* (2013.01); *F25D 11/00* (2013.01); *F25D 23/066* (2013.01); *F25D 23/067* (2013.01); *F25D 2325/021* (2013.01); *F25D 2331/803* (2013.01)

(58) Field of Classification Search
CPC ..... F25D 25/02; F25D 25/024; F25D 25/025; F25D 23/066; F25D 23/067; F25D 11/00; F25D 2325/021; F25D 2331/803; A47B 88/423; A47B 88/0418; A47B 88/43; A47B 88/044; A47B 88/407; A47B 88/0407; A47B 2210/0054
See application file for complete search history.

(56) References Cited

U.S. PATENT DOCUMENTS

| | | | | |
|---|---|---|---|---|
| 1,816,694 | A | 7/1931 | Pope | |
| 1,828,435 | A * | 10/1931 | Otte | F25D 25/02 312/408 |
| 1,946,532 | A * | 2/1934 | Hatch | F25D 25/024 108/143 |
| 3,219,405 | A * | 11/1965 | Costantini | F25D 25/02 312/351 |
| 8,220,285 | B2 * | 7/2012 | Park | F25D 23/021 62/340 |
| 8,651,599 | B2 | 2/2014 | Benz et al. | |
| 10,281,197 | B2 | 5/2019 | Ammerman et al. | |
| 2004/0263038 | A1 | 12/2004 | Ribolzi et al. | |
| 2007/0228911 | A1 | 10/2007 | Kim et al. | |
| 2007/0240395 | A9 * | 10/2007 | Kentner | F25D 23/067 55/507 |
| 2012/0043338 | A1 | 2/2012 | Yang et al. | |
| 2018/0231257 | A1 | 8/2018 | Rehage et al. | |

(Continued)

FOREIGN PATENT DOCUMENTS

| | | | | |
|---|---|---|---|---|
| DE | 60114081 | | 7/2006 | |
| DE | 102009002444 | A1 * | 10/2010 | F25D 23/067 |
| DE | 102009002503 | | 10/2010 | |

(Continued)

*Primary Examiner* — Andrew M Roersma
(74) *Attorney, Agent, or Firm* — Price Heneveld LLP

(57) ABSTRACT

A shelving system for an appliance may include a sidewall adapter coupled to a side of a cabinet liner. The sidewall adapter may include a body defining at least one ledge and a base plate coupled to the at least one ledge. The base plate may define at least one aperture configured to receive a tab on a glide assembly. At least two adjustable fasteners may be coupled to the cabinet liner and may be configured to mount the sidewall adapter to the cabinet liner. A shelf may be coupled to the glide assemblies such that the shelf is slideable within the cabinet liner.

20 Claims, 10 Drawing Sheets

(56) References Cited

U.S. PATENT DOCUMENTS

2019/0069672 A1 3/2019 Pan et al.

FOREIGN PATENT DOCUMENTS

| | | | | | |
|---|---|---|---|---|---|
| DE | 102009020052 | A1 * | 11/2010 | ..... | A47B 88/43 |
| DE | 102009027165 | A1 | 12/2010 | | |
| EP | 2956032 | B1 | 4/2017 | | |
| ES | 2709425 | | 4/2019 | | |

* cited by examiner

SIDE WALL ATTACHMENT SYSTEM FOR EXTRACTABLE WINE SHELVES

BACKGROUND OF THE DISCLOSURE

The present disclosure generally relates to a shelving system for an appliance, and more specifically, to a shelving system for a refrigerating appliance, such as a wine cooler.

SUMMARY OF THE DISCLOSURE

According to one aspect of the present disclosure, a shelving system for an appliance includes a cabinet liner defining opposing sidewalls, a rear wall, a top wall and a bottom wall and defining an interior. The shelving system further includes opposing first and second sidewall adapters each coupled to the opposing sidewalls of the cabinet liner. The first and second sidewall adapters each include a body defining a plurality of vertically spaced ledges and a base plate coupled to each of the ledges. The base plate defines at least one aperture configured to receive a tab on a glide assembly and at least one magnet is disposed within the base plate and is configured to attract the glide assembly. At least two adjustable fasteners are coupled to the cabinet liner and are configured to mount one of the sidewall adapters to the cabinet liner. A shelf is coupled to the glide assemblies such that the shelf is slideable fore and aft.

According to another aspect of the present disclosure, a shelving system for an appliance includes a sidewall adapter coupled to a side of a cabinet liner. The sidewall adapter includes a body defining at least one ledge and a base plate coupled to the at least one ledge. The base plate defines at least one aperture configured to receive a tab on a glide assembly. At least two adjustable fasteners are coupled to the cabinet liner and are configured to mount the sidewall adapter to the cabinet liner. A shelf is coupled to the glide assemblies such that the shelf is slideable within the cabinet liner.

According to yet another aspect of the present disclosure, a shelving system for an appliance includes a cabinet liner defining opposing sidewalls, a rear wall, a top wall and a bottom wall defining an interior. The shelving system further includes opposing first and second sidewall adapters each coupled to the opposing sidewalls of the cabinet liner. The first and second sidewall adapters each include a body defining a plurality of vertically spaced ledges and a base plate coupled to each of the ledges. The base plate defines at least one aperture and is configured to receive a tab on a glide assembly. At least two adjustable fasteners are coupled to the cabinet liner and are configured to mount one of the sidewall adapters to the cabinet liner. A shelf is coupled to the glide assemblies such that the shelf is slideable fore and aft.

These and other features, advantages, and objects of the present disclosure will be further understood and appreciated by those skilled in the art by reference to the following specification, claims, and appended drawings.

Figure 1:
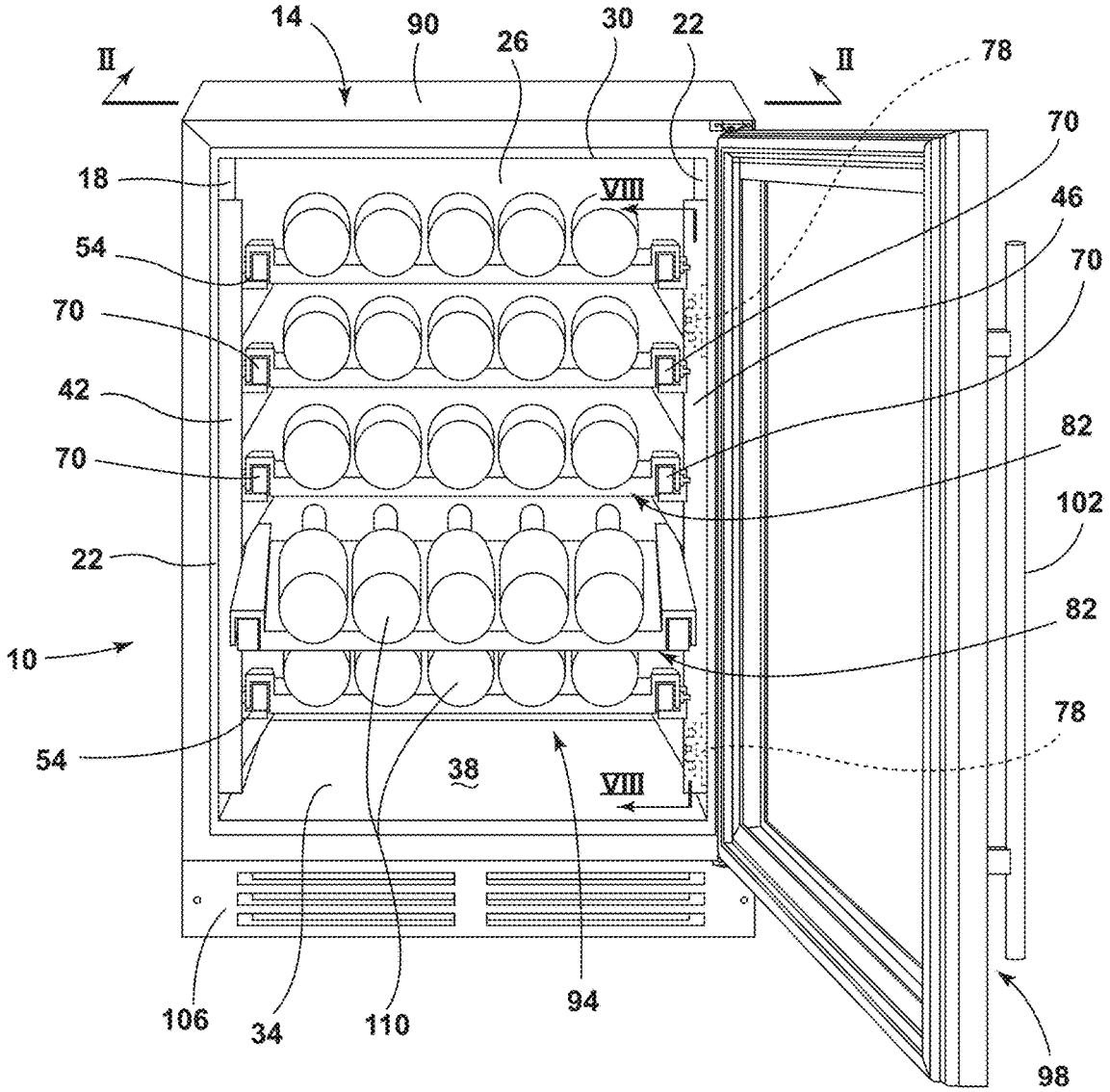
FIG. 1 is a front perspective view of a wine cooler according to various aspects described herein.

The components in the figures are not necessarily to scale, emphasis instead being placed upon illustrating the principles described herein.

DETAILED DESCRIPTION

The present illustrated embodiments reside primarily in combinations of method steps and apparatus components related to shelving system for an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-5, reference numeral 10 generally designates a shelving system for an appliance 14. The shelving system 10 may include a cabinet liner 18 defining opposing sidewalls 22, a rear wall 26, a top wall 30 and a bottom wall 34 and defining an interior 38. The shelving system 10 may also include opposing first and second sidewall adapters 42, 46, respectively, each coupled to the opposing sidewalls 22 of the cabinet liner 18. The first and second sidewall adapters 42, 46 may include a body 50 defining a plurality of vertically spaced ledges 54. A base plate 58 may be coupled to each of the ledges 54, and may define at least one aperture 62 configured to receive a tab 66 on a glide assembly 70. At least one magnet 74 may be disposed within the base plate 58 to attract the glide assembly 70. Furthermore, at least two adjustable fasteners 78 may be coupled to the cabinet liner 18. The adjustable fasteners 78 may mount one of the sidewall adapters 42, 46 to the cabinet liner 18. Additionally, a shelf 82 may be coupled to the glide assemblies 70 such that the shelf 82 is slideable fore and aft.

Referring now to FIG. 1, the appliance 14 is illustrated. Although the appliance 14 is illustrated as a wine cooler, or wine cellar, the appliance 14 may be in the form of any appliance, which may include cooling appliances such as a refrigerator, a freezer, and any combination thereof. In some examples, the appliance 14 may include a vacuum insulated cooling appliance.

The illustrated appliance 14 includes a cabinet 90 defining an access opening 94. A door assembly 98 may selectively cover the access opening 94 and a handle 102 may be provided to facilitate opening and closing of the door assembly 98 to selectively cover the access opening 94. The appliance 14 may also include a grille 106 for covering a ventilation space. However, it is within the scope of aspects described herein for the appliance 14 to include any suitable configuration such that the appliance 14 is not limited to the configuration illustrated herein.

Figure 2:
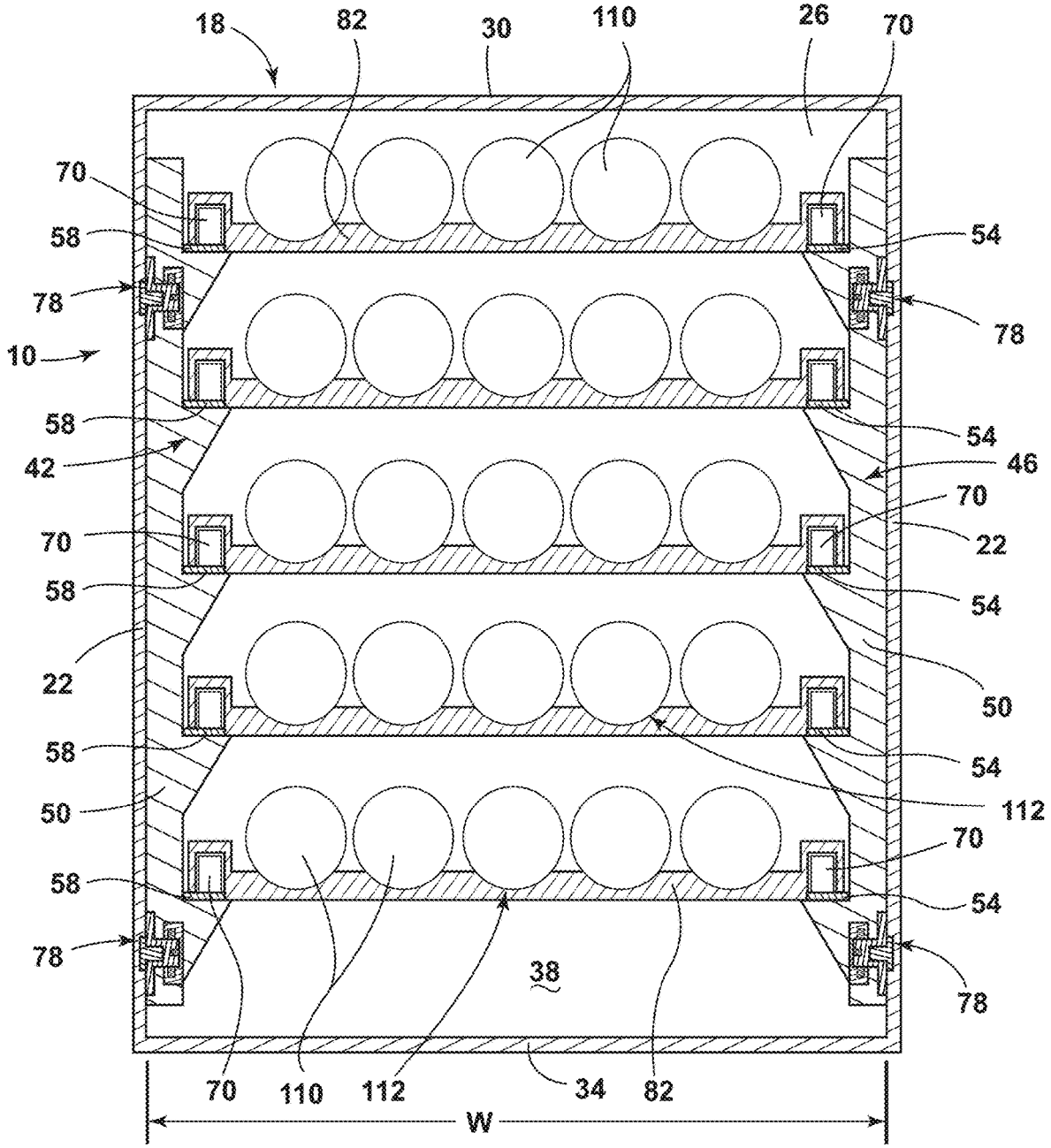
FIG. 2 is a front cross-sectional view of a portion of the wine cooler of FIG. 1 along line II-II according to various aspects described herein.

FIG. 2 is a cross-sectional view the appliance 14 of FIG. 1 shown without the cabinet 90 and further illustrating the interior 38 including the shelving system 10 according to various aspects described herein. The shelving system 10 is configured to compensate for process variation and draft angles of the liner 18. Thus, an inner width, W, of the liner 18, or interior 38, can be set manually, or independently from other variables due to the configuration of the shelving system 10. The sidewall adapters 42, 46 allow space for enhancements, such as advanced lighting or sensors within the interior 38. The sidewall adapters 42, 46 may also be decorative and include patterns, colors, textures, and the like. Furthermore, the sidewall adapters 42, 46 may be made of any suitable material(s), which may include a plastic material such as acrylonitrile butadiene styrene (ABS) or other thermoplastic polymers.

As illustrated, the interior 38 includes a plurality of the shelves 82, or racks, provided for supporting objects such as food, drinks, etc. In some examples, the shelves 82 are configured to support wine bottles 110. Moreover, the shelves 82 may include retention features 112, such as recesses, rods, slots, walls etc. in order to secure the wine bottles 110 in position and may be configured to support the wine bottles 110 in a horizontal, vertical, or angled position. As the shelves 82 may be coupled to the glide assemblies 70, the shelves 82 may be slideable fore and aft relative to the interior 38. In this way, a user may slide one or more of the shelves 82 outwardly, which is best illustrated in FIG. 1, to easily access stored items, such as the wine bottles 110.

Additionally, while FIG. 2 illustrates two adjustable fasteners 78 attaching the first sidewall adapter 42 to the cabinet liner 18 and two adjustable fasteners 78 attaching the second sidewall adapter 46 to the cabinet liner 18, any suitable number of adjustable fasteners 78 may be used. The adjustable fasteners 78 may contribute to the adjustability of the shelving system 10 by allowing for horizontal variation of the width, W, which will be described in more detail with reference to FIGS. 8-10.

Figure 3:
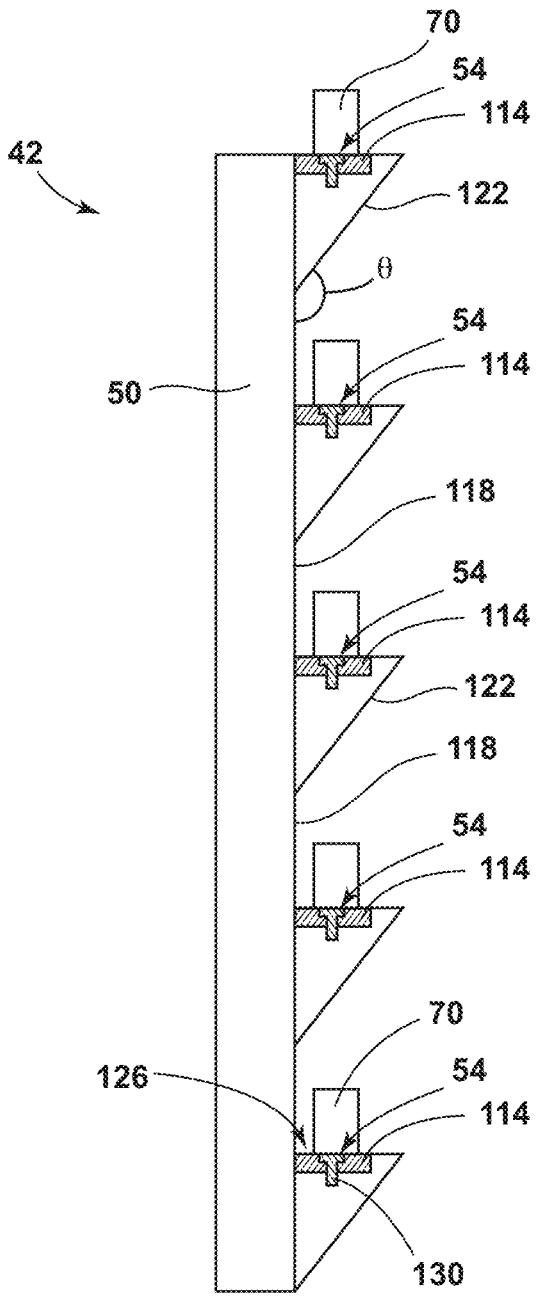
FIG. 3 is an elevation view of a sidewall adapter according to various aspects described herein.

Referring now to FIG. 3, the first and second sidewall adapters 42, 46 may include any suitable number of vertically spaced ledges 54, which may include a single ledge 54, or more than one ledge 54. In specific examples, each sidewall adapter 42, 46 includes five ledges 54. The ledges 54 may be spaced equidistantly from each other, or the ledges 54 may be spaced at variable positions along the body 50. For example, a larger gap between two of the vertically spaced ledges 54 may be provided to accommodate a drawer therebetween.

As illustrated, each ledge 54 defines an upper support surface 114 at an upper surface thereof. The upper support surface(s) 114 on the first sidewall adapter 42 may be aligned with a corresponding upper support surface 114 on the second sidewall adapter 46 in order to provide support for mounting the shelf 82. In this way, a single shelf 82 may be coupled to a ledge 54 on the first sidewall adapter 42 and the corresponding ledge 54 on the second sidewall adapter 46. The upper support surface 114 may be generally orthogonal to a wall portion 118 of the body 50 of the sidewall adapter 42. Furthermore, the upper support surface 114 may be substantially horizontal. It is contemplated that the ledge 54 may define a sloping side surface 122, which intersects the wall portion 118. In some examples, the intersection of the sloping side surface 122 and the wall portion 118 defines an obtuse angle, θ, with respect to the sloping side surface 122 and the wall portion 118. The angle, θ, may be in the range of 115°-145°, but is not limited to such and may include any suitable angle, including acute angles.

Additionally, it is contemplated that the ledges 54 are generally configured to include a sloped, or angled, upper support surface 114. For example, the height of the sloping side surface 122 may increase or decrease along a longitudinal length of the sloping side surface 122 in order to form the sloped upper support surface 114. Alternatively, the ledges 54 may include a substantially equal height along the longitudinal length of the sloping side surface 122, but may be formed, or positioned, at an angle on first and second sidewall adapters 42, 46. In some examples, the upper support surface 114 is sloped downwardly towards the front of the appliance 14, or towards the access opening 94. For example, the upper support surface 114 may include an approximately 10° angle of elevation from the access opening 94. However, the angle of elevation may include any angle from approximately 45° to horizontal. Furthermore, some of the upper support surfaces 114 may be sloped, while others are substantially horizontal in order to provide a plurality of storage configurations. The angle of the upper support surface 114 may directly correlate to the storage angle of the wine bottles 110. Moreover, a sloped upper support surface 114 of the ledge 54 may be advantageous for the storage of wine bottles 110 as positioning of the wine bottles 110 such that the cork is angled downwardly may aid keeping the wine in constant contact with the cork thereby ensuring no air gets into the bottle and the cork remains moist. However, it is also contemplated that a horizontal storage angle may also effectively preserve the wine in the wine bottles 110.

As shown, the ledges 54 may include a recess 126 in the upper support surface 114 dimensioned to receive the base plate 58. Thus, a void defined by the recess 126 may include a substantially rectangular cuboid shape. The base plate 58 may be fixed within the recess 126 by any suitable means, which may include fasteners 130, adhesives and the like. According to some aspects, the recess 126 may be dimensioned such that the base plate 58 is generally level with the upper support surface 114. Furthermore, the base plates 58 may be made of any suitable material, which may include a sheet metal material.

Figure 4:
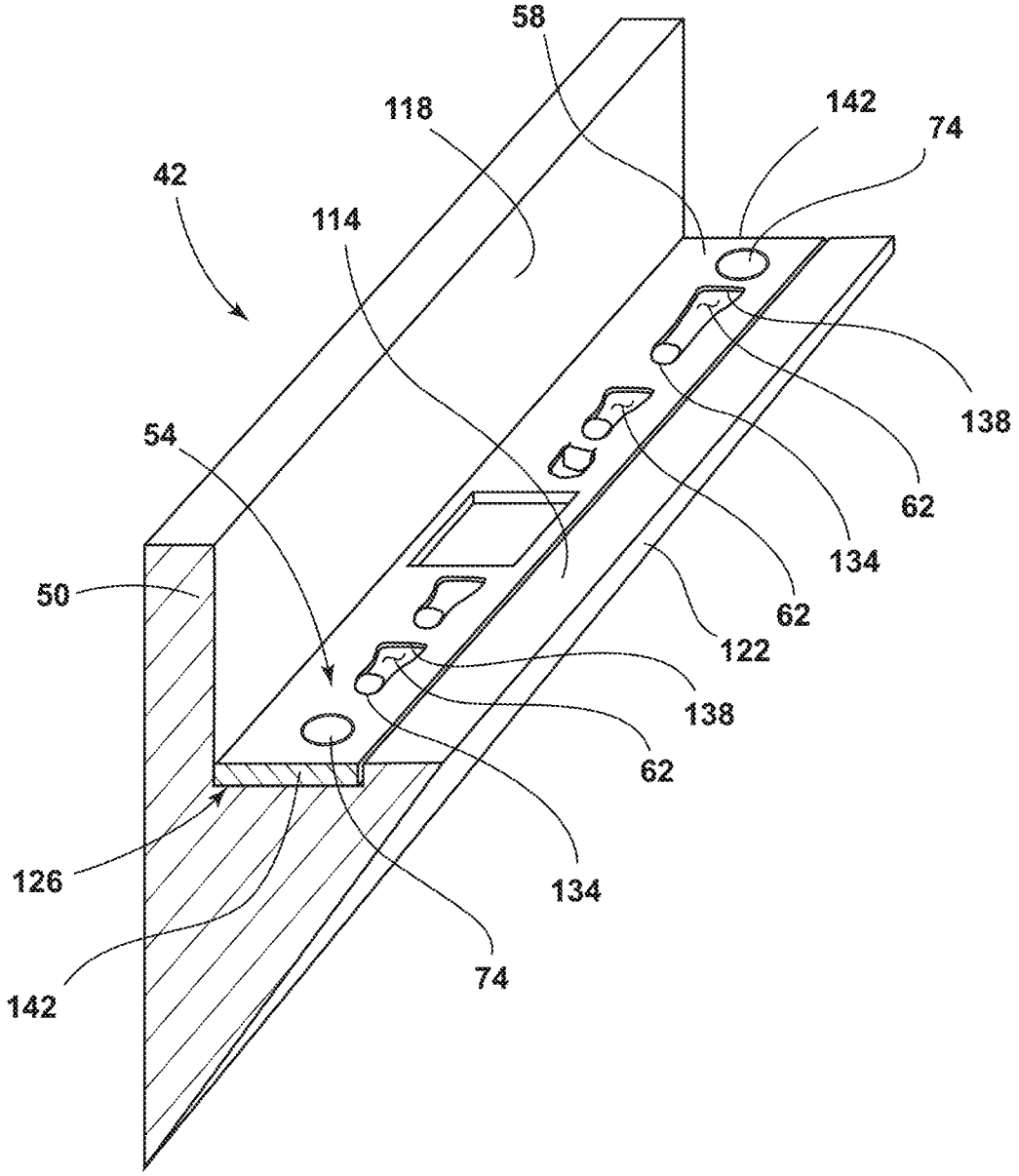
FIG. 4 is a perspective view of a portion of the sidewall adapter of FIG. 3 according to various aspects described herein.

FIG. 4 is directed to a portion of the sidewall adapter 42, further illustrating the base plate 58 according to various aspects described herein. The base plate 58 may define the at least one aperture 62 to include a first side 134 and a second side 138. The second side 138 may be wider than the first side 134 and may include a profile similar to that of an isosceles trapezoid. In this way, the second side 138 may be configured to receive the tab 66 of the glide assembly 70 such that the tab 66 may be inserted therein. It is within the scope of the disclosure for the base plate 58 to include any number of apertures 62 in order to receive any number of tabs 66 on the glide assembly 70. In some examples, the apertures 62 may not include identical shapes. For example, one aperture may be longer than another aperture 62. Additionally, the apertures 62 may be generally aligned along a length of the base plate 58. In specific examples, the at least one magnet 74 may be disposed within the base plate 58 may include a pair of magnets each positioned adjacent an end 142 of the base plate 58 in order to attract the glide assembly 70 to the base plate 58.

Figure 5:
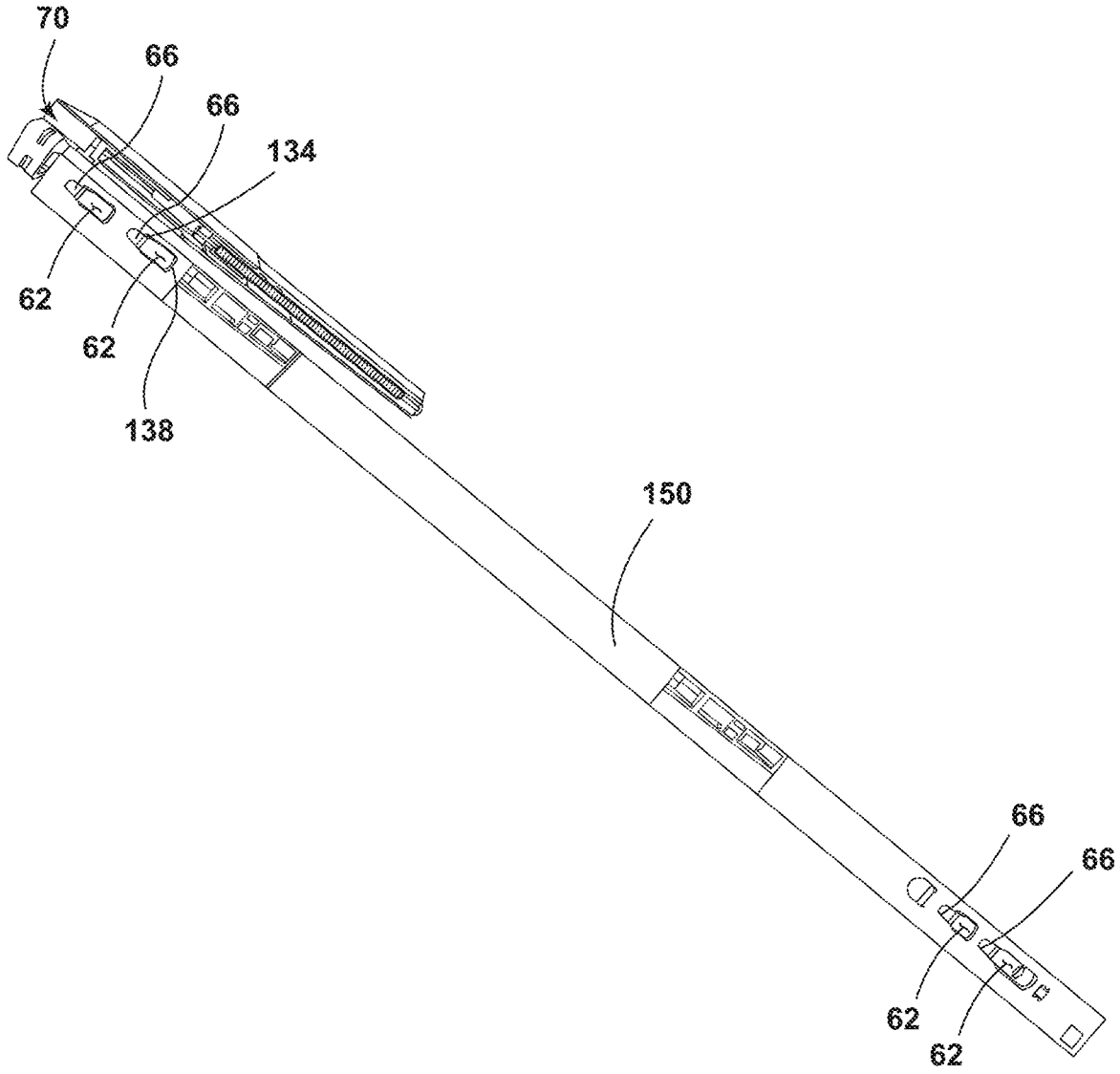
FIG. 5 is a bottom, perspective view of a base plate and a glide according to various aspects described herein.

FIG. 5 illustrates an underneath surface 150 of the base plate 58 with a glide assembly 70 mounted thereto according to various aspects described herein. The tab(s) 66 may be inserted into the aperture(s) 62 and slid in the direction of the first side 134 such that the first side 134 retains the tab 66 at the underneath surface 150 of the base plate 58. Thus, the glide assembly may be coupled to the base plate 58. The tabs 66 may depend from the glide assembly 70 and will have a suitable configuration for insertion within the apertures 62 and fixing the glide assembly 70 in position. For example, the tabs 66 may include a pointed tip.

Figure 6:
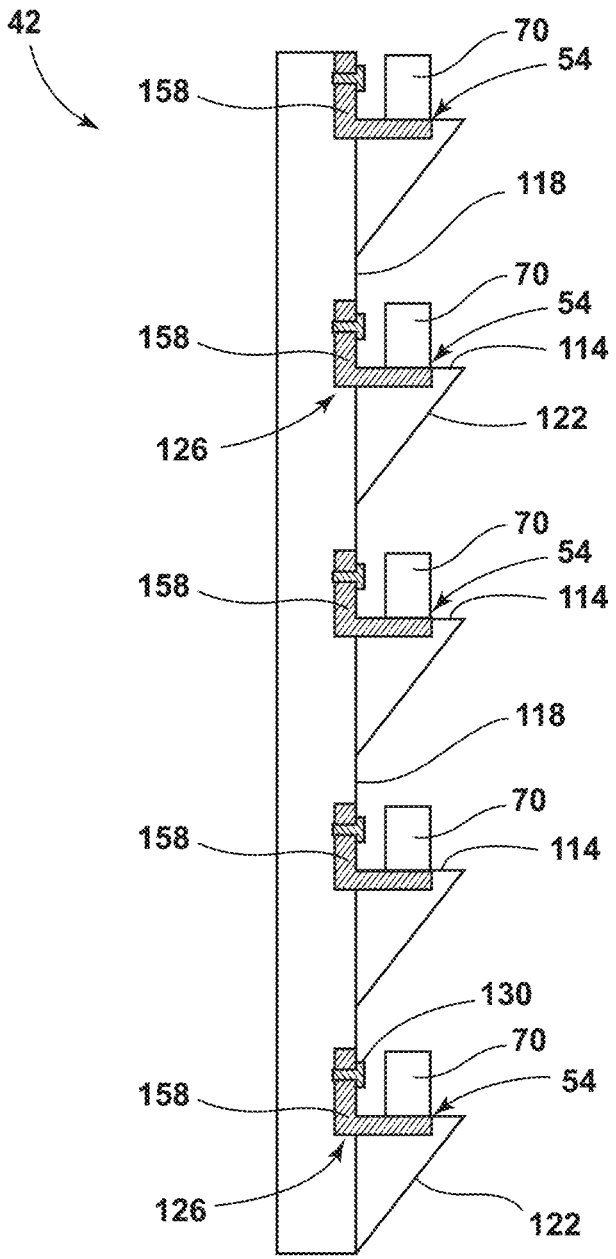
FIG. 6 is an elevation view of another sidewall adapter according to various aspects described herein.

Referring now to FIG. 6, an alternate construction for the base plate 158 is illustrated. The base plate 158 may be similar to the base plate 58 with a difference being that the base plate 158 may include an L-bracket configuration. Therefore, the recess 126 in the upper support surface 114 may also extend to the wall portion 118 of the body 50 to receive the base plate 158. In some instances, the recess 126 may be dimensioned such that the base plate 58 is generally level with the upper support surface 114 and the wall portion 118.

Figure 7:
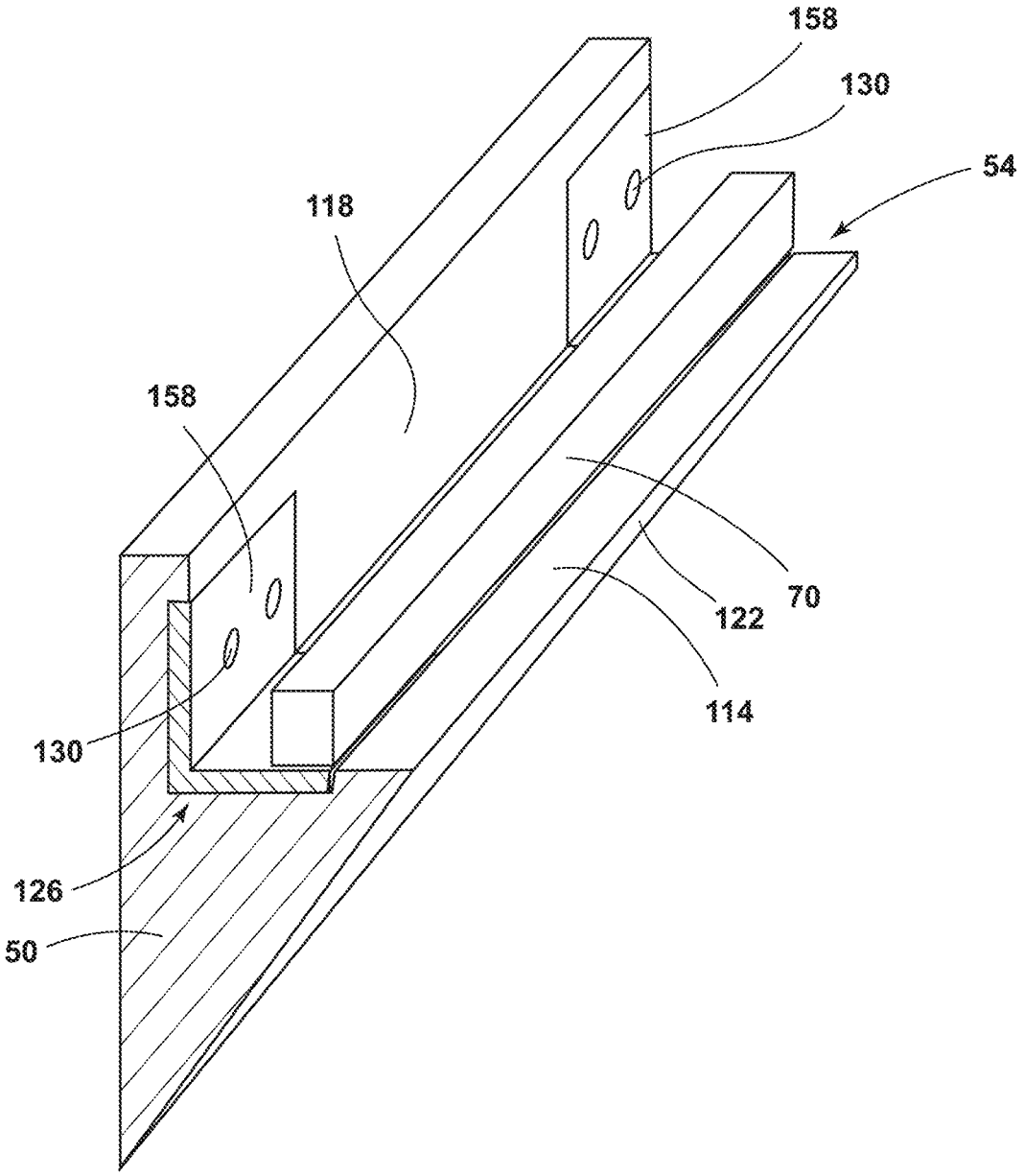
FIG. 7 is a perspective view of a portion of the sidewall adapter of FIG. 6 according to various aspects described herein.

FIG. 7 illustrates a portion of the sidewall adapter 42, further illustrating the base plate 158 according to various aspects described herein. In some examples, the ledge 54 includes a pair of spaced base plates 158. The base plate(s) 158 may include the apertures 62 illustrated in FIG. 4. Alternatively, the glide assembly 70 may be fixed to the base plate(s) 158 by fasteners, clips, etc. Furthermore, the base plate 58 may be fixed within the recess 126 by fasteners 130, adhesives, etc.

Figure 8:
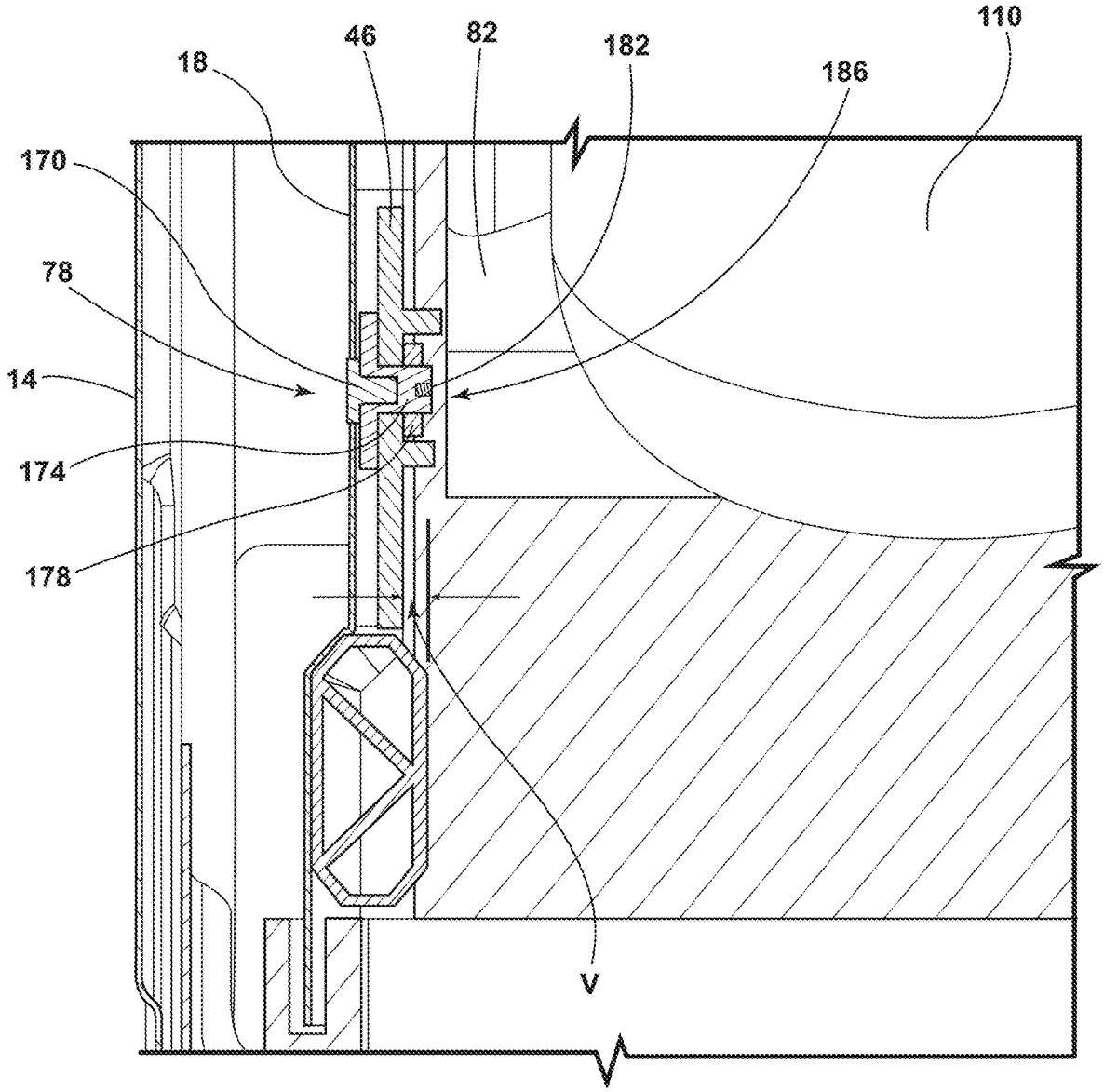
FIG. 8 is a cross-sectional view of a portion of the wine cooler of FIG. 1 including an adjustable fastener according to various aspects described herein.

Referring now to FIG. 8, the adjustable fastener 78 according to various aspects described herein is more clearly illustrated. The illustrated adjustable fastener 78 includes a stud 170, an intermediate member 174 and a locking nut 178. The stud 170 may include external threads and may be fixed to the liner 18, which may include welding the stud 170 to the liner 18. Therefore, in some aspects, the liner 18 includes a metal. The intermediate member 174 may be in the form of an intermediate nut 182 having internal threads and external threads. The intermediate nut 182 and/or the stud 170 may extend into the sidewall adapter 46. The locking nut 178 may be positioned on or in the sidewall adapter 46. In some examples, the sidewall adapter 46 includes a recess 186 configured to receive the locking nut 178. As the external threads of the intermediate nut 182 may receive the locking nut 178, the sidewall adapter 46 may be mounted to the cabinet liner 18.

The adjustable fastener 78 may be laterally adjustable, which may accommodate for variation, V, in the width direction of the liner 18. In some examples, the adjustable fastener 78 is be configured to effectively mount the sidewall adapter 46 relative to the cabinet liner 18 within a range of approximately 4-8 millimeters (mm). As the appliance 14 may include two, opposing sidewall adapters 42, 46, the shelving system 10 can compensate for variation in the width direction of the liner 18 within a range of approximately 8-16 mm.

Figure 9:
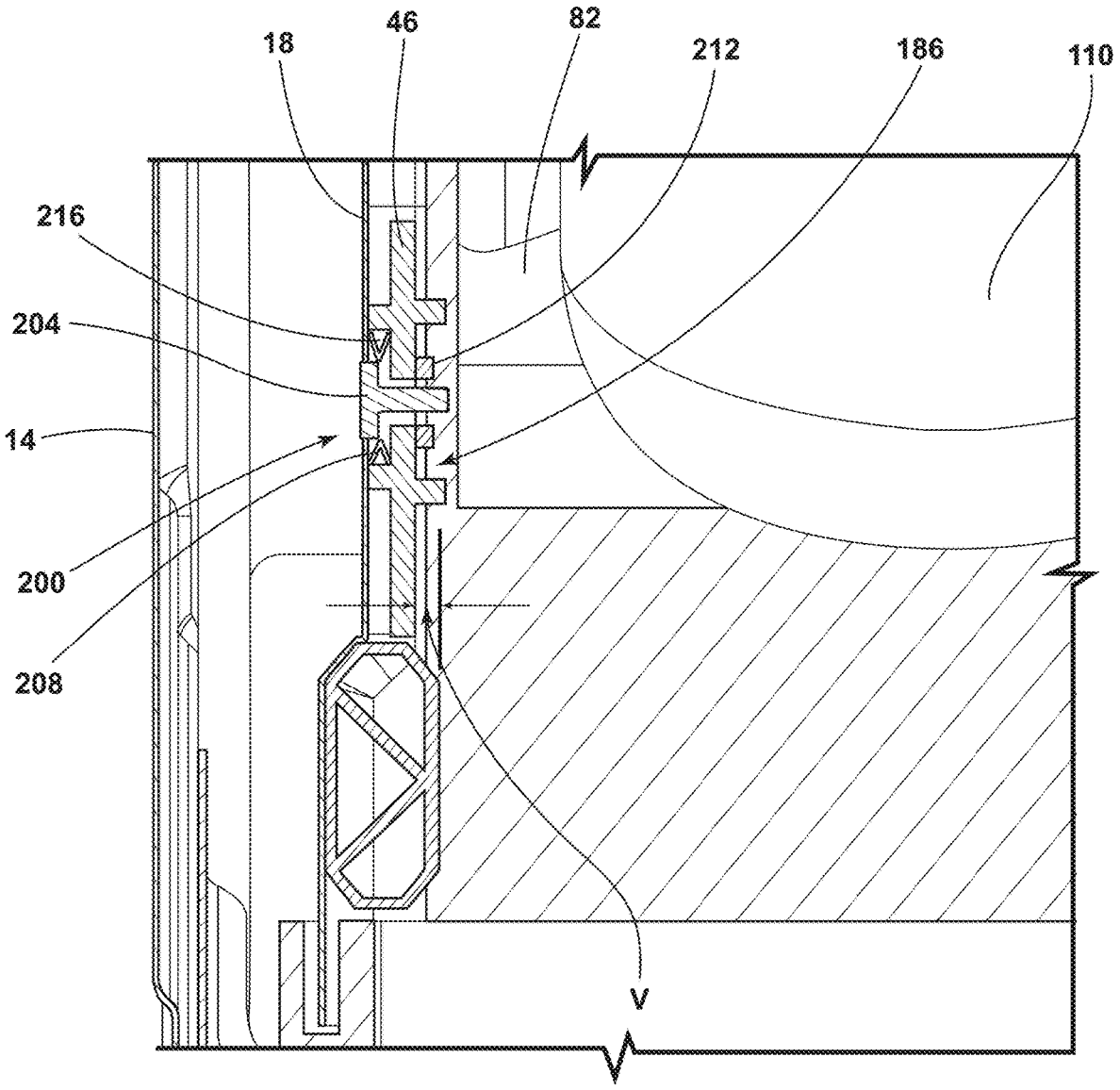
FIG. 9 is a cross-sectional view of a portion of the wine cooler of FIG. 1 including another adjustable fastener according to various aspects described herein.

FIG. 9 illustrates another adjustable fastener 200 according to various aspects described herein. The adjustable fastener 200 may include a stud 204, an intermediate member 208 and a locking nut 212. As illustrated, the intermediate member 208 is in the form of a helical spring 216 configured to exert a compression force on the stud 204 and the cabinet liner 18 when the locking nut 212 is coupled to the stud 204. The stud 204 may extend into the sidewall adapter 46. As the locking nut 212 can be positioned on or in the sidewall adapter 46, the locking nut 212 can receive the stud 204 to mount the sidewall adapter 46 to the cabinet liner 18. In some examples, the recess 186 is configured to receive the locking nut 212.

Figure 10:
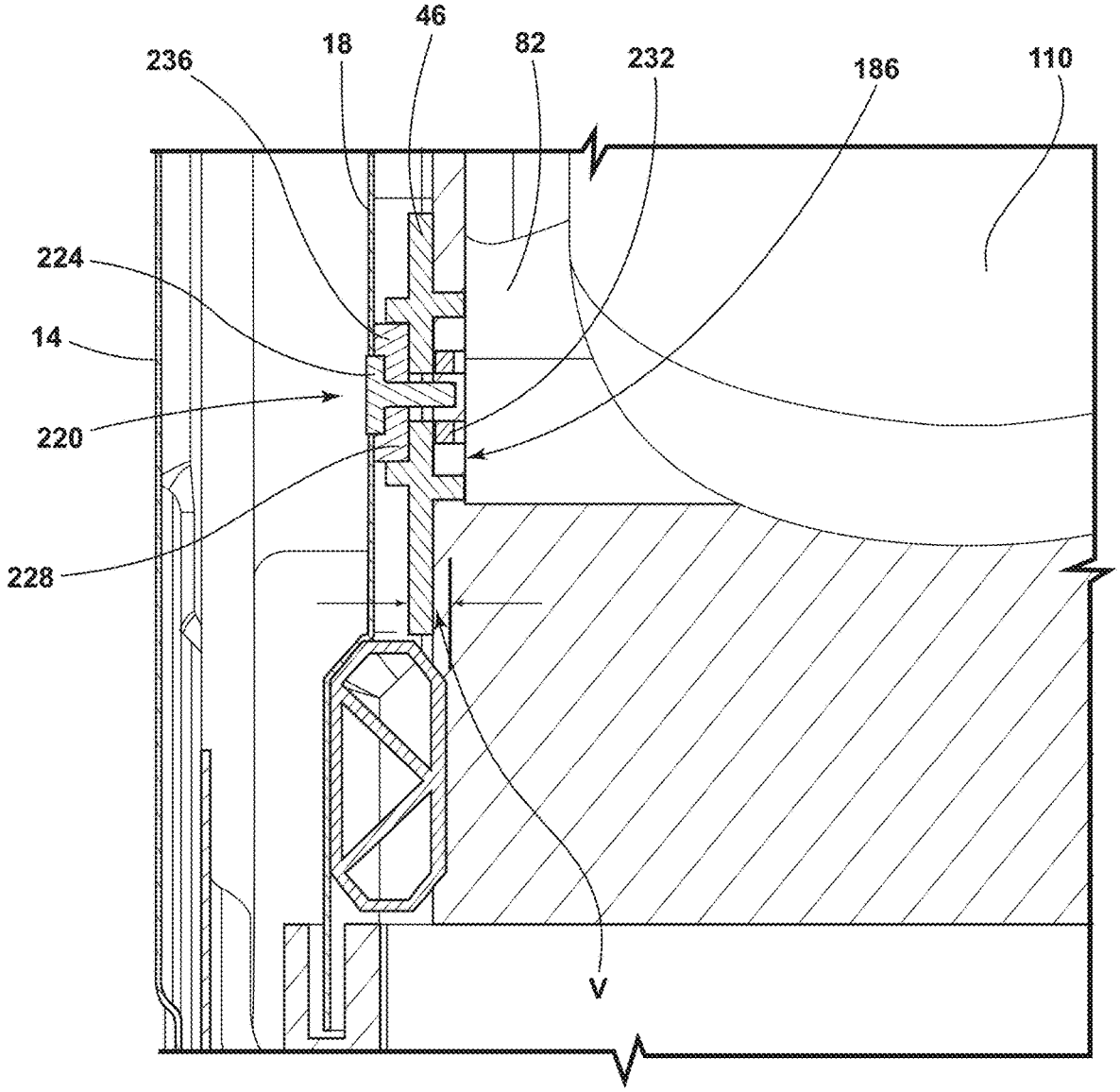
FIG. 10 is a cross-sectional view of a portion of the wine cooler of FIG. 1 including yet another adjustable fastener according to various aspects described herein.

FIG. 10 illustrates another adjustable fastener 220 according to various aspects described herein. The adjustable fastener 220 may include a stud 224, an intermediate member 228 and a locking nut 232. The intermediate member 228 may be in the form of a polymeric washer 236 configured to distribute a compression force on the stud 224 and the cabinet liner 18 when the locking nut 232 is coupled to the stud 224. The stud 224 may extend into the sidewall adapter 46. As the locking nut 232 may be positioned on or in the sidewall adapter 46, the locking nut 232 may receive the stud 224 to mount the sidewall adapter 46 to the cabinet liner 18. In some examples, the recess 186 is configured to receive the locking nut 232.

According to one aspect of the present disclosure, a shelving system for an appliance includes a cabinet liner defining opposing sidewalls, a rear wall, a top wall and a bottom wall and defining an interior. The shelving system further includes opposing first and second sidewall adapters each coupled to the opposing sidewalls of the cabinet liner. The first and second sidewall adapters each include a body defining a plurality of vertically spaced ledges and a base plate coupled to each of the ledges. The base plate defines at least one aperture configured to receive a tab on a glide assembly and at least one magnet is disposed within the base plate and is configured to attract the glide assembly. At least two adjustable fasteners are coupled to the cabinet liner and are configured to mount one of the sidewall adapters to the cabinet liner. A shelf is coupled to the glide assemblies such that the shelf is slideable fore and aft.

According to another aspect, the vertically spaced ledges include a recess in an upper surface thereof and the recess is dimensioned to receive the base plate.

According to yet another aspect, the base plate defines the at least one aperture to include a first side and a second side, the second side wider than the first side and configured to receive the tab such that upon insertion of the tab into the aperture, the first side retains the tab at an underneath surface thereof.

According to yet another aspect, the base plate defines at least two apertures.

According to yet another aspect, the adjustable fasteners each include a stud including external threads mounted to the cabinet liner, an intermediate member and a locking nut including internal threads and the intermediate member is coupled to the stud and the locking nut is coupled to one of the stud and the intermediate member to mount the one of the sidewall adapters to the cabinet liner.

According to yet another aspect, the intermediate member further includes an intermediate nut including internal threads and external threads wherein the internal threads of the intermediate nut receive the stud and the external threads of the intermediate nut receive the locking nut to mount the one of the sidewall adapters to the cabinet liner.

According to yet another aspect, the intermediate member further includes a helical spring configured to exert a compression force on the stud and the cabinet liner when the locking nut is coupled to the stud to mount the one of the sidewall adapters to the cabinet liner.

According to yet another aspect, the intermediate member further includes a polymeric washer configured to distribute a compression force on the stud and the cabinet liner when the locking nut is coupled to the stud to mount the one of the sidewall adapters to the cabinet liner.

According to one aspect of the present disclosure, a shelving system for an appliance includes a sidewall adapter coupled to a side of a cabinet liner. The sidewall adapter includes a body defining at least one ledge and a base plate coupled to the at least one ledge. The base plate defines at least one aperture configured to receive a tab on a glide assembly. At least two adjustable fasteners are coupled to the cabinet liner and are configured to mount the sidewall adapter to the cabinet liner. A shelf is coupled to the glide assemblies such that the shelf is slideable within the cabinet liner.

According to another aspect, the at least one ledge includes a recess in an upper surface thereof and the recess is dimensioned to receive the base plate.

According to yet another aspect, the base plate defines the at least one aperture to include a first side and a second side, the second side wider than the first side and configured to receive the tab such that upon insertion of the tab into the aperture, the first side retains the tab at an underneath surface thereof.

According to yet another aspect, the adjustable fasteners each include a stud including external threads mounted to the cabinet liner, an intermediate member and a locking nut including internal threads and the intermediate member is coupled to the stud and the locking nut is coupled to one of the stud and the intermediate member to mount the one of the sidewall adapters to the cabinet liner.

According to one aspect of the present disclosure, a shelving system for an appliance includes a cabinet liner defining opposing sidewalls, a rear wall, a top wall and a bottom wall defining an interior. The shelving system further includes opposing first and second sidewall adapters each coupled to the opposing sidewalls of the cabinet liner. The first and second sidewall adapters each include a body defining a plurality of vertically spaced ledges and a base plate coupled to each of the ledges. The base plate defines at least one aperture and is configured to receive a tab on a glide assembly. At least two adjustable fasteners are coupled to the cabinet liner and are configured to mount one of the sidewall adapters to the cabinet liner. A shelf is coupled to the glide assemblies such that the shelf is slideable fore and aft.

According to another aspect, the ledges each define an upper support surface generally perpendicular to a wall portion of the sidewall adapter and also define a sloping side surface that intersects the wall portion, thereby defining an obtuse angle with respect to the sloping side surface and the wall portion.

According to yet another aspect, the vertically spaced ledges include a recess in the upper surface and the recess is dimensioned to receive the base plate.

According to yet another aspect, the base plate defines the at least one aperture to include a first side and a second side, the second side wider than the first side and configured to receive the tab such that upon insertion of the tab into the aperture, the first side retains the tab at an underneath surface thereof and the glide assembly is coupled to the base plate.

According to yet another aspect, the base plate defines at least two apertures.

According to yet another aspect, the adjustable fasteners each include a stud including external threads mounted to the cabinet liner, an intermediate member and a locking nut including internal threads and the intermediate member is coupled to the stud and the locking nut is coupled to one of the stud and the intermediate member to mount the one of the sidewall adapters to the cabinet liner.

According to yet another aspect, the intermediate member further includes an intermediate nut including internal threads and external threads wherein the internal threads of the intermediate nut receive the stud and the external threads of the intermediate nut receive the locking nut to mount the one of the sidewall adapters to the cabinet liner.

According to yet another aspect, the intermediate member further includes one of a helical spring and a polymeric washer and the locking nut is coupled to the stud to mount the one of the sidewall adapters to the cabinet liner.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A shelving system for an appliance, the shelving system comprising:

a cabinet liner defining opposing sidewalls, a rear wall, a top wall and a bottom wall, the cabinet liner defining an interior;

opposing first and second sidewall adapters coupled to the opposing sidewalls of the cabinet liner, the first and second sidewall adapters each comprising:

a body defining a plurality of vertically spaced ledges;

a base plate coupled to each of the ledges, the base plate defining at least one aperture receiving a tab on a glide assembly; and at least one magnet disposed within the base plate configured to attract the glide assembly; and at least two adjustable fasteners coupled to the cabinet liner, the at least two adjustable fasteners configured to mount one of the sidewall adapters to the cabinet liner, wherein a shelf is coupled to the glide assemblies such that the shelf is slideable fore and aft.

2. The shelving system for an appliance of claim 1, wherein the vertically spaced ledges include a recess in an upper surface thereof, the recess dimensioned to receive the base plate.

3. The shelving system for an appliance of claim 1, wherein the base plate defines the at least one aperture to include a first side and a second side, the second side wider than the first side and configured to receive the tab such that upon insertion of the tab into the aperture, the first side retains the tab at an underneath surface thereof.

4. The shelving system for an appliance of claim 1, wherein the base plate defines at least two said apertures.

5. The shelving system for an appliance of claim 1, wherein the adjustable fasteners each comprise:

a stud including external threads mounted to the cabinet liner;

an intermediate member; and a locking nut including internal threads, wherein the intermediate member is coupled to the stud and the locking nut is coupled to one of the stud and the intermediate member to mount the one of the sidewall adapters to the cabinet liner.

6. The shelving system for an appliance of claim 5, wherein the intermediate member further comprises an intermediate nut including internal threads and external threads, wherein the internal threads of the intermediate nut receive the stud and the external threads of the intermediate nut receive the locking nut to mount the one of the sidewall adapters to the cabinet liner.

7. The shelving system for an appliance of claim 5, wherein the intermediate member further comprises a helical spring configured to exert a compression force on the stud and the cabinet liner when the locking nut is coupled to the stud to mount the one of the sidewall adapters to the cabinet liner.

8. The shelving system for an appliance of claim 5, wherein the intermediate member further comprises a polymeric washer configured to distribute a compression force on the stud and the cabinet liner when the locking nut is coupled to the stud to mount the one of the sidewall adapters to the cabinet liner.

9. A shelving system for an appliance, the shelving system comprising:

a sidewall adapter coupled to a side of a cabinet liner, the sidewall adapter comprising:

a body defining at least one ledge; and a base plate coupled to the at least one ledge, the base plate defining at least one aperture receiving a tab on a glide assembly; and at least two adjustable fasteners coupled to the cabinet liner, the at least two adjustable fasteners configured to mount the sidewall adapter to the cabinet liner, wherein a shelf is coupled to the glide assemblies such that the shelf is slideable within the cabinet liner.

10. The shelving system for an appliance of claim 9, wherein the at least one ledge includes a recess in an upper surface thereof, the recess dimensioned to receive the base plate.

11. The shelving system for an appliance of claim 9, wherein the base plate defines the at least one aperture to include a first side and a second side, the second side wider than the first side and configured to receive the tab such that upon insertion of the tab into the aperture, the first side retains the tab at an underneath surface thereof.

12. The shelving system for an appliance of claim 9, wherein the adjustable fasteners each comprise:

a stud including external threads mounted to the cabinet liner;

an intermediate member; and a locking nut including internal threads, wherein the intermediate member is coupled to the stud and the locking nut is coupled to one of the stud and the intermediate member to mount the one of the sidewall adapters to the cabinet liner.

13. A shelving system for an appliance, the shelving system comprising:

a cabinet liner defining opposing sidewalls, a rear wall, a top wall and a bottom wall, the cabinet liner defining an interior;

opposing first and second sidewall adapters coupled to the opposing sidewalls of the cabinet liner, the first and second sidewall adapters each comprising:

a body defining a plurality of vertically spaced ledges; and a base plate coupled to each of the ledges, the base plate defining at least one aperture receiving a tab on a glide assembly; and at least two adjustable fasteners coupled to the cabinet liner, the at least two adjustable fasteners configured to mount one of the sidewall adapters to the cabinet liner, wherein a shelf is coupled to the glide assemblies such that the shelf is slideable fore and aft.

14. The shelving system for an appliance of claim 13, wherein the ledges each define an upper support surface generally perpendicular to a wall portion of the sidewall adapter and also define a sloping side surface that intersects the wall portion, thereby defining an obtuse angle with respect to the sloping side surface and the wall portion.

15. The shelving system for an appliance of claim 14, wherein the vertically spaced ledges include a recess in the upper surface, the recess dimensioned to receive the base plate.

16. The shelving system for an appliance of claim 13, wherein the base plate defines the at least one aperture to include a first side and a second side, the second side wider than the first side and configured to receive the tab such that upon insertion of the tab into the aperture, the first side retains the tab at an underneath surface thereof and the glide assembly is coupled to the base plate.

17. The shelving system for an appliance of claim 13, wherein the base plate defines at least two said apertures.

18. The shelving system for an appliance of claim 13, wherein the adjustable fasteners each comprise:

a stud including external threads mounted to the cabinet liner;

an intermediate member; and a locking nut including internal threads, wherein the intermediate member is coupled to the stud and the locking nut is coupled to one of the stud and the intermediate member to mount the one of the sidewall adapters to the cabinet liner.

19. The shelving system for an appliance of claim 18, wherein the intermediate member further comprises an intermediate nut including internal threads and external threads, wherein the internal threads of the intermediate nut receive the stud and the external threads of the intermediate nut receive the locking nut to mount the one of the sidewall adapters to the cabinet liner.

20. The shelving system for an appliance of claim 18, wherein the intermediate member further comprises one of a helical spring and a polymeric washer and the locking nut is coupled to the stud to mount the one of the sidewall adapters to the cabinet liner.

* * * * *